US006122836A

United States Patent [19]

Tenedini et al.

[11] Patent Number: 6,122,836

[45] Date of Patent: Sep. 26, 2000

[54] FREEZE DRYING APPARATUS AND METHOD EMPLOYING VAPOR FLOW MONITORING AND/OR VACUUM PRESSURE CONTROL

[75] Inventors: Kenneth J. Tenedini; Siegfried G. Bart, Jr., both of New Paltz, N.Y.

[73] Assignee: S.P. Industries, Inc., The Virtis Division, Gardiner, N.Y.

[21] Appl. No.: 09/074,248

[22] Filed: May 7, 1998

[51] Int. Cl.[7] ..... F26B 13/30

[52] U.S. Cl. ..... 34/92; 34/287; 34/403

[58] Field of Search ..... 34/192, 284, 287, 34/292, 293, 297, 407, 558, 559, 565, 566, 567, 570, 571, 92, 286, 237, 5; 73/118, 861.78, 861.33, 861.77; 62/126, 129, 150

[56] References Cited

U.S. PATENT DOCUMENTS

| | | | |
|---|---|---|---|
| 3,311,991 | 4/1967 | Gidlow | 34/5 |
| 3,381,746 | 5/1968 | Wiegmann et al. | 165/111 |
| 3,741,009 | 6/1973 | Bordeaux | 73/118 |
| 3,945,603 | 3/1976 | Fraser | 251/148 |
| 3,991,603 | 11/1976 | Wonn et al. | 73/29 |
| 4,017,983 | 4/1977 | Fraser | 34/92 |
| 4,084,330 | 4/1978 | Fraser | 34/92 |
| 4,177,577 | 12/1979 | Bird | 34/92 |
| 4,265,127 | 5/1981 | Onoda | 73/861.78 |
| 4,449,305 | 5/1984 | Baron et al. | 34/92 |
| 4,547,977 | 10/1985 | Tenedini et al. | 34/46 |
| 4,597,188 | 7/1986 | Trappler | 34/5 |

(List continued on next page.)

FOREIGN PATENT DOCUMENTS

| | | | |
|---|---|---|---|
| 1354/66 | 8/1967 | Australia | 34/559 |

OTHER PUBLICATIONS

Dr. Hanna Willemer, "Quality Control in Freeze–Drying of Pharmaceuticals", Preliminary Laboratory Tests—G.M.P. Proceedures—Monitoring and Control in the Course of Drying, Tuesday, pp. 1–20, Apr. 3, 1990.

J.W. Snowman, "Improvements In The Freeze Drying Process", American Laboratory, pp. 55–57,Aug. 1976.

The Virtis Company, Inc., "Virtis Guide to Laboratory Freeze Drying", pp. 1–12, 1982.

VirTis, "Performance–Matched Lyophilizers From Virtis—Configured to Customer Order", pp. 1–14, Apr. 1995.

VirTis, "Introducing Genesis SQ Freeze Dryers From Virtis—If Your Lab Doesn't Already Have A Genesis, The Time Has Come", p. 1, Mar. 1996.

T.A. Jennings, Ph.D., "Effect of Pressure on the Sublimation Rate of Ice", Research Article, vol. 40, No. 3, pp. 95–96, May–Jun. 1986.

VirTis "World–Class Laboratory Equipment From Virtis—Just Ask Anyone In The World", pp. 1–23, May 1996.

(List continued on next page.)

*Primary Examiner*—Denise L. Ferensic
*Assistant Examiner*—Andrea M. Joyce
*Attorney, Agent, or Firm*—Heslin & Rothenberg, P.C.

[57] ABSTRACT

Freeze drying apparatus and associated lyophilization procedures are provided employing vapor flow detection and/or vacuum control for monitoring and control of the lyophilization process. The vapor flow detector, such as a windmill sensor, is disposed to monitor vapor flow from product undergoing lyophilization. In a batch process, vapor flow is collectively monitored with the vapor flow detector between the process chamber and condenser chamber, while in a manifold configuration separate vapor flow detectors are employed at each flask attachment port. A windmill sensor provides visual feedback to an operator and/or electronic feedback to a system controller. A vacuum control system is also provided for use with or independent of vapor flow detection. This vacuum control disconnects the vacuum source from the process chamber when pressure within the process chamber falls below a first predefined set point. The vacuum source is then reconnected if process chamber pressure rises above a second predefined set point.

32 Claims, 11 Drawing Sheets

U.S. PATENT DOCUMENTS

| | | | |
|---|---|---|---|
| 4,780,964 | 11/1988 | Thompson, Sr. | 34/5 |
| 4,793,190 | 12/1988 | Chang | 73/861.33 |
| 4,823,478 | 4/1989 | Thompson, Sr. | 34/5 |
| 4,912,359 | 3/1990 | Offutt et al. | 312/306 |
| 4,949,473 | 8/1990 | Steinkamp | 34/92 |
| 4,966,469 | 10/1990 | Fraser et al. | 374/208 |
| 5,035,065 | 7/1991 | Parkinson | 34/92 |
| 5,496,733 | 3/1996 | Spandau et al. | 436/52 |
| 5,522,155 | 6/1996 | Jones | 34/286 |
| 5,689,895 | 11/1997 | Sutherland et al. | 34/92 |
| 5,743,023 | 4/1998 | Fay et al. | 34/287 |
| 5,822,882 | 10/1998 | Anger | 34/296 |
| 5,884,414 | 3/1999 | Anger | 34/92 |
| 5,964,043 | 10/1999 | Oughton et al. | 34/92 |
| 6,012,339 | 1/2000 | Genack et al. | 73/861.77 |

OTHER PUBLICATIONS

International Institute of Refrigeration—Meeting of Commission C1 (May 20–22, 1985), "Fundamentals and Applications of Freeze–Drying to Biological Materials, Drugs and Foodstuffs", pp. 368–385, 1985.

VirTis, "The ultimate in User–Friendly Design—The New Ultra Series Freeze Dryers From Virtis", pp. 1–3, Dec. 1994.

VirTis, "AdVantage Benchtop Freeze Dryers—First In A New Line Of Intelligent Freeze Dryers", pp. 1–3, Sep. 1997.

VirTis, "VirTis Genesis SQ Freeze Dryers—Just Look Who's Already Using Genesis", p. 1, May 1997.

VirTis, "Lyophilization Control Systems—The Heart Of Intelligent Freeze Drying", pp. 1–3, May 1997.

VirTis, "VirTis Benchmark 1000 To 3000 Freeze Dryers—The Freeze Dryer You Design Yourself", pp. 1–3, May 1997.

FREEZE DRYING APPARATUS AND METHOD EMPLOYING VAPOR FLOW MONITORING AND/OR VACUUM PRESSURE CONTROL

TECHNICAL FIELD

This invention relates generally to freeze drying apparatus and associated lyophilization procedures, and more particularly, to a vapor flow detector and vacuum control system for improved monitoring and control of the lyophilization process.

BACKGROUND OF THE INVENTION

Freeze drying has been used for the preservation of a wide variety of foods, pharmaceutical, and biological products. Freeze drying enables the removal through sublimation of solvents, including water, from a substance without destroying its cellular structure. Through sublimation, the substance being freeze dried remains in a frozen, solid form until it is dried, i.e., until all liquid is removed from the substance.

During freeze drying, a constantly changing state of unbalance must exist between product ice and system pressure/temperature conditions. The migration of water vapor from the product ice interface occurs only if this state of unbalance exists and the product ice is at a higher energy level than the rest of the system. Freeze drying equipment is designed to present an isolated set of controlled conditions effecting and maintaining the optimum temperature pressure differences for a given product, thereby drying the product in a least amount of time.

The limit of unbalance is determined by the maximum amount of heat which can be applied to the product without causing a change from solid to liquid state (i.e., "melt back"). This may occur even though the chamber pressure is low since the product dries from the surface closest to the area of lowest pressure. This surface is called the ice interface. The arrangement of the drying, solid particles above this interface offers resistance to the vapors released from below raising the product pressure/temperature. To avoid "melt back", heat energy applied to the product must not exceed the rate at which water vapor leaves the product. Another limit is the rate at which heat energy applied to the product ice (and carried away by the migrating vapors) is removed by the condenser refrigeration system. Only by maintaining a low condenser temperature can vapors be trapped as ice particles and effectively removed from the system, thereby greatly reducing and simplifying the vacuum pumping requirement. Air, and other non-condensible molecules within the chamber, as well as mechanical restrictions located between the product ice and the condenser, offer additional resistance to the movement of vapors migrating towards the condenser.

Four conditions are essential for freeze drying. These conditions must be met in the following order: (1) the product must be solidly frozen below its eutectic point or glass transition temperature; (2) a condensing surface capable of reaching temperatures approximately 200 colder than any ice interface temperature must be provided (typically lower than −40° C.); (3) the system must be capable of evacuation to an absolute pressure of between 5 and 25 microns of Hg; and, (4) a source of heat input to the product, controlled between −40° C. and +65° C., must be employed to provide the heat required to drive water from the solid to the vapor state (heat of sublimation).

The physical arrangement of equipment designed to satisfy the above four conditions varies widely, and includes individual flask freeze drying apparatus and batch process freeze drying apparatus.

When process results must be exacting and when process control is important, such as in the chemical and pharmaceutical industry, including the research and development aspects thereof, freeze drying processes are carried out in chambers on a batch basis. This allows an operator to more precisely control what occurs to the product being sublimed. Monitor and control of the freeze drying process continue to be significant issues within the industry.

For example, the temperature level within product containers used for freeze drying is critical to proper sublimation. During the freeze drying operation, the temperature of the substance within at least one container is often monitored by a temperature sensor, such as a thermocouple. Various devices for positioning a temperature sensor in a freeze drying container are described in the art. In this regard, reference commonly assigned U.S. P. No. 5,689,895, by Sutherland et al. entitled "Probe Positioning Device For A Flask For Freeze Drying."

Although valuable, temperature measurement by itself may be inaccurate, depending upon placement of the thermocouple, and has certain inherent limitations. For example, temperature measurement might be used to note a point of transition from primary drying to secondary drying, but is unable to accurately identify the rate of drying or whether the freeze drying process is in fact complete.

In view of the above, any control improvements which can be used to enhance commercial operation of a freeze drying apparatus are of significant interest to the industry. The present invention is directed to meeting these needs for various monitoring and control enhancements to the freeze drying process.

DISCLOSURE OF THE INVENTION

Briefly summarized, this invention comprises in one aspect a freeze drying apparatus including a process chamber for accommodating a plurality of product containers, and a condenser chamber in communication with the process chamber via a channel. A vacuum source produces a vacuum on the condenser chamber and the process chamber. A vapor flow detector is disposed to monitor vapor flow to the condenser chamber, thereby providing information on the rate of freeze drying, as well as completion of freeze drying processing. As an enhanced embodiment, the vapor flow detector comprises a windmill sensor disposed within the channel interconnecting the process chamber and the condenser chamber.

In another aspect, the invention comprises a freeze drying apparatus for freeze drying product adapted to be contained in a frozen state in at least one flask. The freeze drying apparatus includes a manifold presenting a sealed interior chamber and at least one port adapted to receive at least one flask to place the interior of the flask and the product therein in gaseous communication with the interior chamber of the manifold. The apparatus also includes a condenser and a vacuum pump. The condenser is associated with the interior chamber of the manifold for condensing condensible vapors present in the interior chamber. The vacuum pump produces a vacuum within the interior chamber of the manifold for reducing ambient pressure in the interior chamber. A vacuum flow detector is disposed to monitor vapor flow from product in at least one flask coupled to the manifold during freeze drying processing.

In still another aspect, the invention again comprises a freeze drying apparatus for freeze drying product. This apparatus includes a process chamber for accommodating a plurality of product containers, and a condenser chamber in gaseous fluid communication with the process chamber. A vacuum pump produces a vacuum on the condenser chamber and process chamber, and a process controller is connected to the vacuum pump. The process controller monitors freeze drying within the freeze drying apparatus, and during freeze drying processing, selectively disconnects the vacuum pump from the condenser and process chambers without impairing freeze drying processing.

In a further aspect, a method for freeze drying product in a process chamber (coupled via a channel to a condenser chamber) is provided. The method includes: establishing frozen product to undergo lyophilization in the process chamber; establishing a condenser within the condenser chamber and subjecting the process chamber and condenser chamber to evacuation, whereby a very low atmosphere approaching a vacuum is maintained within the process chamber; performing freeze drying processing on the product within the process chamber; and monitoring vapor flow from product exposed in the process chamber.

In a still further aspect, a method for freeze drying product employing a process chamber is described which includes: sealing the product within the process chamber; freeze drying the product within the process chamber, wherein the freeze drying includes using a vacuum source to establish a vacuum within the process chamber, and disconnecting the vacuum source from the process chamber whenever pressure within the process chamber falls below a first predefined set point.

To restate, the present invention comprises freeze drying apparatuses and associated lyophilization procedures employing vapor flow detection and/or vacuum disconnect/connect control for improved monitoring and control of the freeze drying process. A vapor flow detector in accordance with the principles of the this invention can provide visual and/or electronic feedback on drying rate, as well as function as an end of drying indicator. The rate of drying can be utilized in an electronic feedback signal to automatically regulate, for example, shelf heat temperature and/or vacuum level during freeze drying processing. In large industrial freeze dryers, the vapor flow detector can comprise an end of freeze drying indicator, which is preferably implemented using an alternate path from the product chamber to the condenser. The vapor flow detector installed in this alternate path is selectively used only in the final stages of freeze drying to identify completion of the process. Further, in a manifold apparatus, a central vapor flow detector or vapor flow port detectors located at the flask attachment ports can be used separately or in combination.

Energy savings can be achieved during lyophilization by automatically disabling the vacuum pump when pressure in the process chamber falls below a predefined set point. Controlling pressure within the process chamber can thus be attained by enabling and disabling the vacuum pump in response to measured pressure within the chamber. Further, selective disabling of the vacuum pump advantageously reduces vacuum pump oil migration or "backstreaming" by the percentage of pump off-time, and also reduces vacuum pump temperature. By controlling pressure within the process chamber only through selective connecting/disconnecting of the vacuum pump, a higher level of product purity is achieved compared with the conventional requirement of an inert gas bleed system, while still providing comparable level of pressure control utilizing pressure generated by the product undergoing freeze drying. The speed of freeze drying will also increase since only higher specific heat water vapor is employed to provide convective heat transfer within the process chamber, rather than injected air or inert gas.

A further advantage of the present invention arises from employing the refrigeration system's discharge heat to selectively increase the rate of freeze drying by increasing the surrounding heat (heat of sublimation) over freeze drying flasks connected to a freeze dryer's manifold system. Adjustable vents can be used to manually or automatically adjust heat flow over the external freeze drying flasks as desired.

BRIEF DESCRIPTION OF THE DRAWINGS

The above-described objects, advantages and features of the present invention, as well as others, will be more readily understood from the following detailed description of certain preferred embodiments of the invention, when considered in conjunction with the accompanying drawings in which.

BEST MODE FOR CARRYING OUT THE INVENTION

Figure 1A:
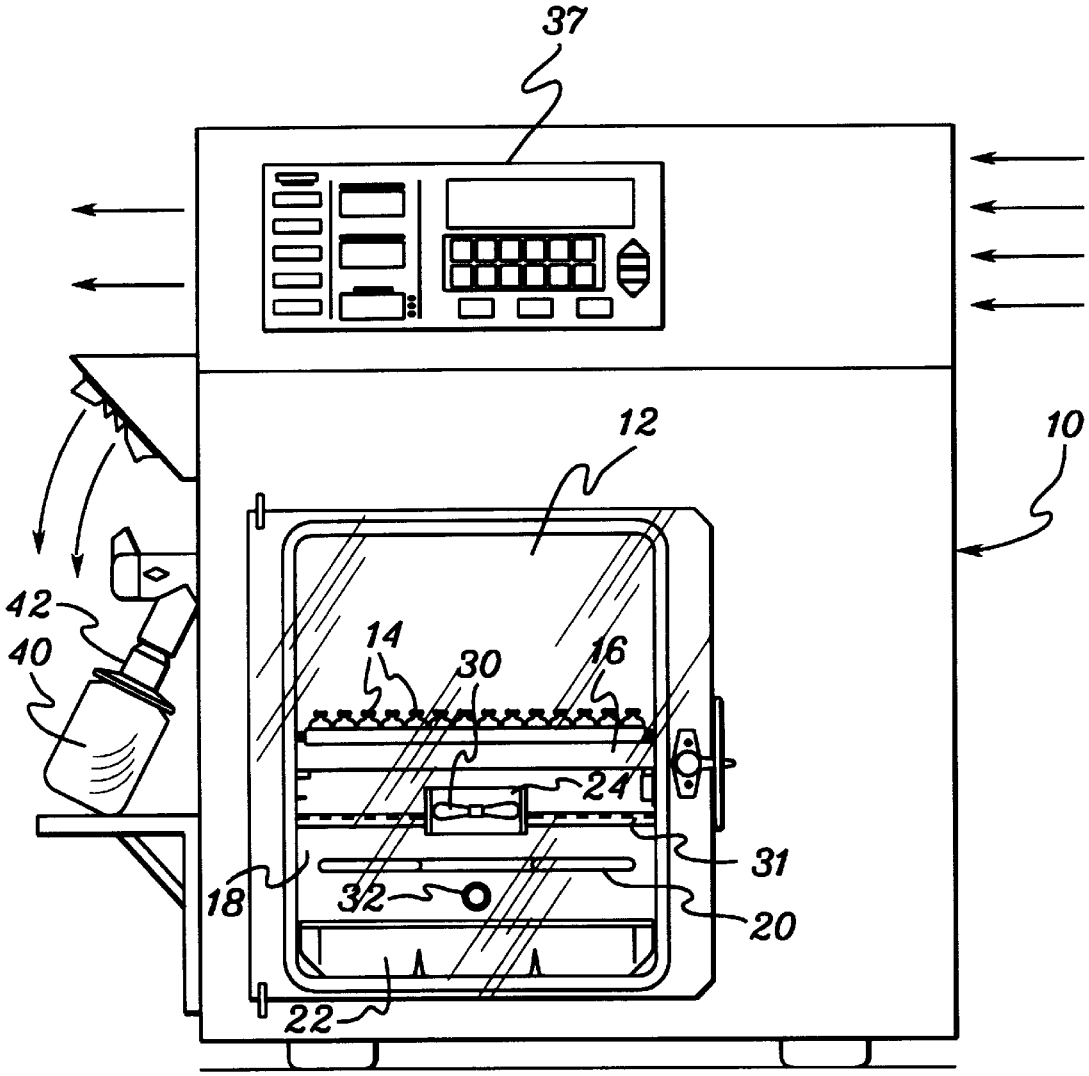
FIGS. 1*a* & 1*b* are a front elevational view and side elevational view, respectively, of one embodiment of a freeze drying apparatus in accordance with the principles of the present invention.

All of the various aspects of the present invention relate to the lyophilization process and to the sensing of critical process parameters and/or control enhancements thereof. Enhanced monitoring of lyophilization processing is achieved in accordance with the principles of the present invention through use of one or more vapor flow detector(s), while enhanced control of the lyophilization process is achieved through, for example, selective deactivation of the vacuum source applied to the process chamber. Each of these aspects, as well as additional features of the invention, are described below with reference to various freeze drying apparatuses. In the figures, the same reference numbers used in multiple figures designate the same or similar components.

FIGS. 1*a*, 1*b*, 2 & 3 depict one embodiment of a freeze drying apparatus, generally denoted 10, pursuant to this invention. Apparatus 10 includes a batch process chamber 12 having product containers 14 disposed on one or more shelves 16. Process chamber 12 is separated from a condenser chamber 18 by a baffle 31 having an opening or channel 24 which allows fluid communication between process chamber 12 and condenser chamber 18. By way of specific example, channel 24 may have an interior diameter of approximately three inches.

Figure 3:
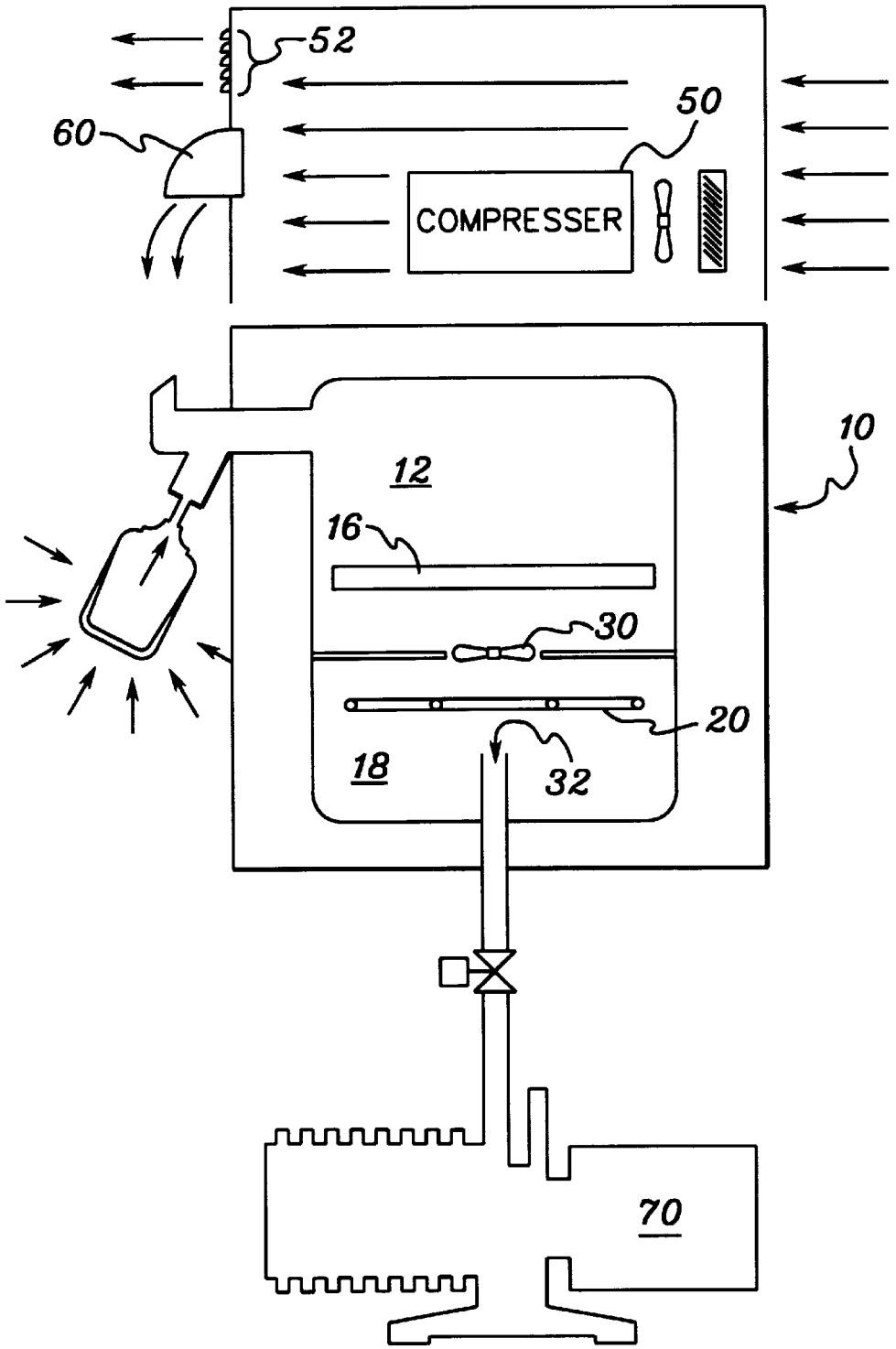
FIG. 3 is a schematic of the freeze drying apparatus of FIGS. 1*a*–2.

Chamber 18 includes a condenser coil 20 which operates at a lower temperature than process chamber 12 to maintain any trapped water vapor at a pressure below the pressure of water remaining in the product undergoing freeze drying. Condenser chamber 18 includes a collection tray 22 in a lower portion thereof for collecting water during a defrost cycle, i.e., after freeze drying the product. A passageway 32 couples the condenser chamber to a vacuum pump 70 (FIG. 3).

Vacuum pump 70 evacuates air contained within the process and condenser chambers to a sufficiently low pressure (for example, a few 100 thousandths of an atmosphere) to essentially establish a vacuum. The resultant reduction of molecular density of the gaseous atmosphere in the process and condenser chambers facilitates movement of water molecules from the product to the condenser.

In accordance with this invention, a vapor flow detector 30 (also referred to herein as windmill sensor 30) is disposed within channel 24 coupling process chamber 12 and condenser chamber 18. In one embodiment, this vapor flow detector may comprise a windmill sensor configured to determine rate of vapor flow through channel 24. However, those skilled in the art will understand that the vapor flow detector presented herein is not limited to a windmill sensor configuration. For example, a pinwheel sensor or a float sensor (wherein a ball floats within a volume, at least part of which is calibrated) as well as other approaches, could be used to provide feedback on the rate of vapor flow through the channel. The appended claims are intended to encompass all such vapor flow detection devices.

Windmill sensor 30 is sized to ensure that vapor flow between product chamber 12 and condenser chamber 18 will drive the sensor. The momentum of kinetic energy generated by vapor flow from the product undergoing freeze drying to the low temperature condenser causes the windmill to spin. The observed turning speed is directly proportional to the rate of drying and the mass transfer rate. As the freeze drying process proceeds, less free ice is available to sublimate, and eventually all free ice will be sublimed, with the observed rate of vapor flow gradually slowing.

During the final stages of drying, the windmill will turn much slower due to the smaller amount of water vapor moving from the product chamber to the condenser chamber. A certain, product dependant, portion of the original water content of the product may not be converted to free ice during freeze drying, but rather remain in the product in the form of bound moisture. This bound moisture will eventually depart the product by a process known as secondary drying. The windmill sensor detects secondary drying by turning more slowly and eventually stopping when the magnitude of the vapor flow is almost zero, i.e., when the magnitude is equal to the load friction of the windmill's turbine bearings. Experiments indicate that a windmill sensor such as disclosed herein provides very repeatable results and a wealth of information during the freeze drying process, as well as detecting end of freeze drying. A windmill sensor follows the basic fan law rules and can be readily utilized by an operator in a visual configuration. If the windmill sensor is turning, then the product is still emanating water vapor and the freeze drying process is incomplete.

Figure 5A:
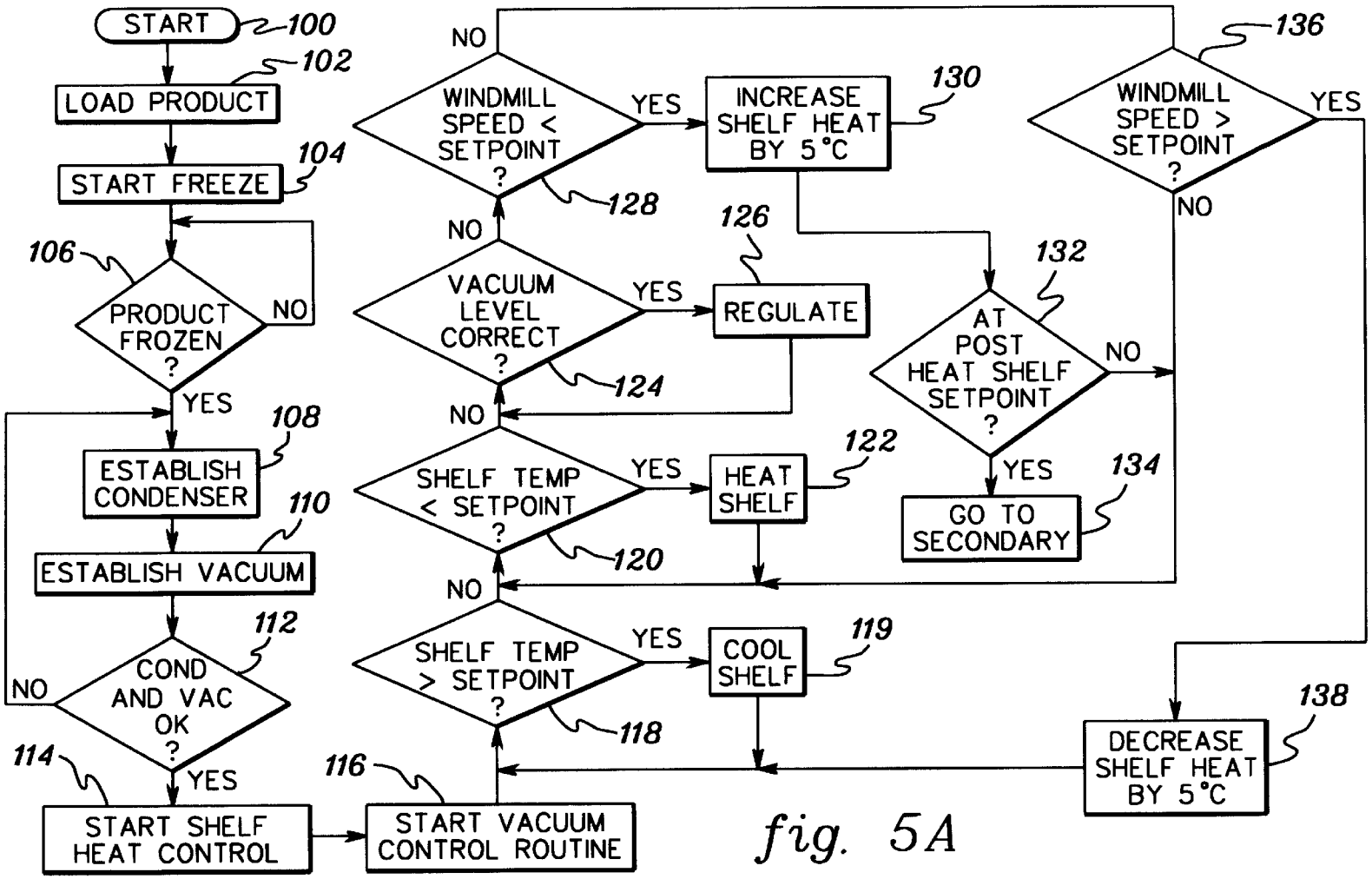
FIG. 5*a* is a flowchart of one embodiment of primary freeze drying processing in accordance with the present invention.
Figure 5B:
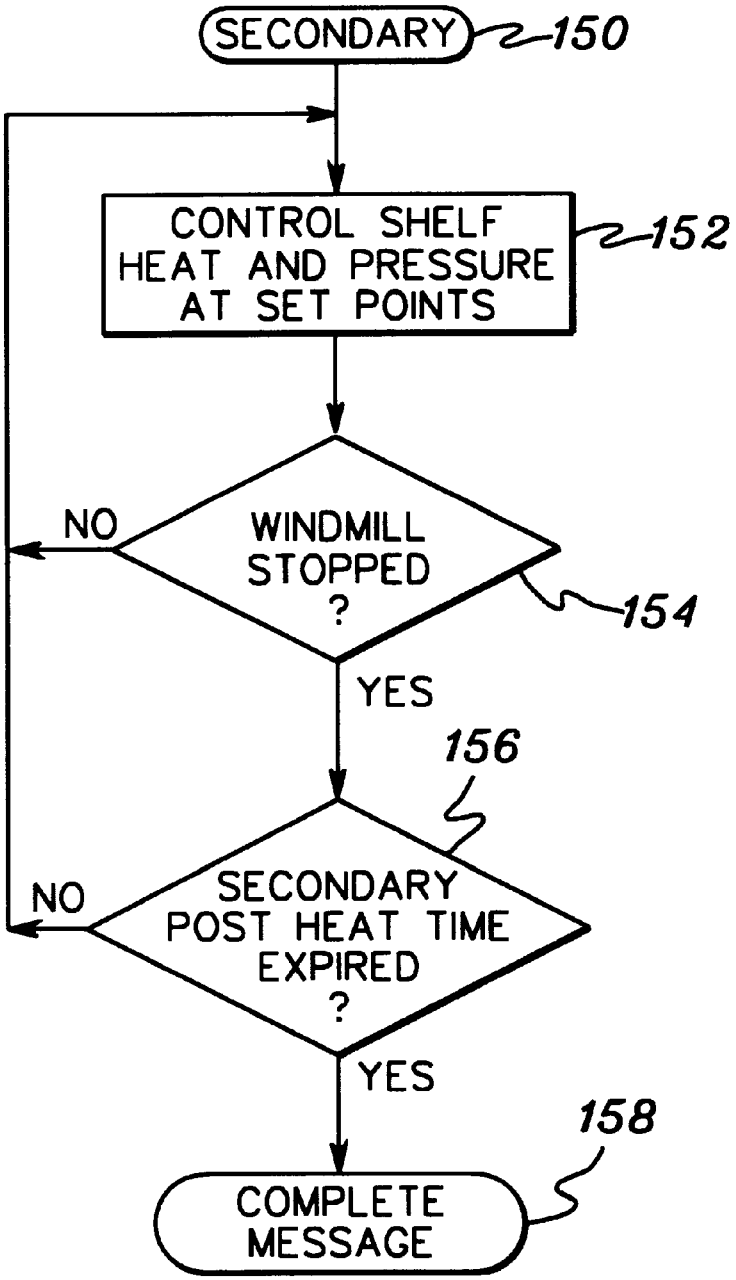
FIG. 5*b* is a flowchart of one embodiment of secondary freeze drying processing pursuant to the present invention.

As an enhancement, a basic windmill sensor (or other type of vapor flow detector) can be modified with an electronic sensor to detect the speed of the windmill and provide, e.g., RPM feedback to a system controller 37 (FIG. 1*a*). The resulting output can be utilized either as a trend device or as a control element. FIGS. 5*a* & 5*b* depict one embodiment of how the windmill sensor output may be utilized in a control technique in accordance with the principles of the present invention.

Figure 1B:
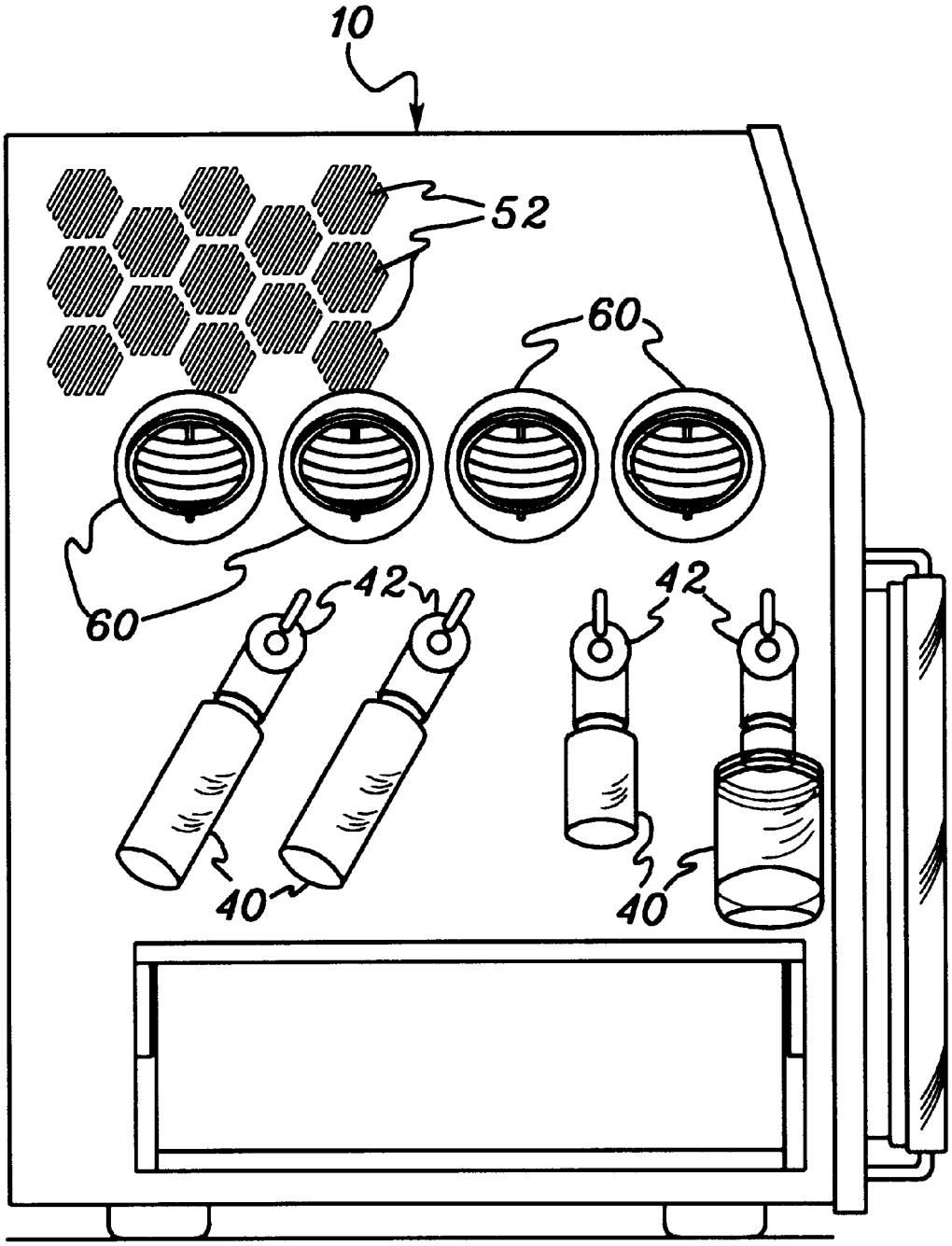
Figure 2:
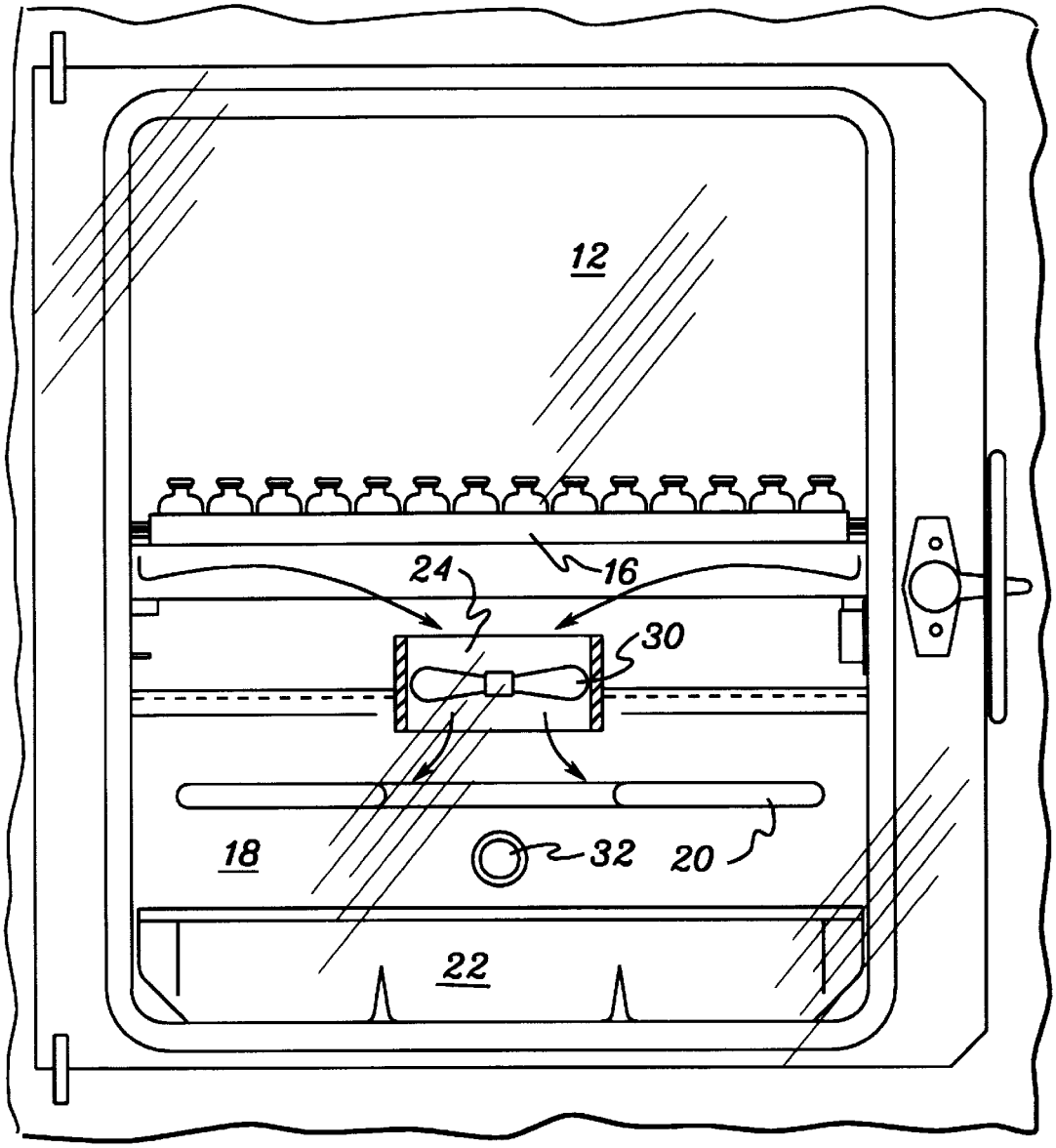
FIG. 2 is a partially enlarged view of the freeze drying apparatus of FIG. 1*a;*

A further aspect of this invention is also depicted in FIGS. 1*a*, 1*b* & 3. As shown, a compressor 50 for condenser loop 20 generates heat, which is typically exhausted into the surrounding environment through vents 52. However, during secondary drying of product contained within external flasks 40 (in communication with process chamber 12 through airtight valves 42) additional heat may facilitate removal of bound water from the product. In accordance with the present invention, this additional heat is provided by directing exhaust heat from compressor 50 onto selected product flasks 40 through adjustable vents 60. Adjustability is needed because during primary drying, the extremely sensitive nature of some freeze drying products makes the addition of exhaust heat to the area surrounding the flasks undesirable, while after detecting secondary drying (for example, by noting that product temperature within flasks 40 has reached room temperature), additional heat of sublimation on the external product flasks is desirable.

Figure 4:
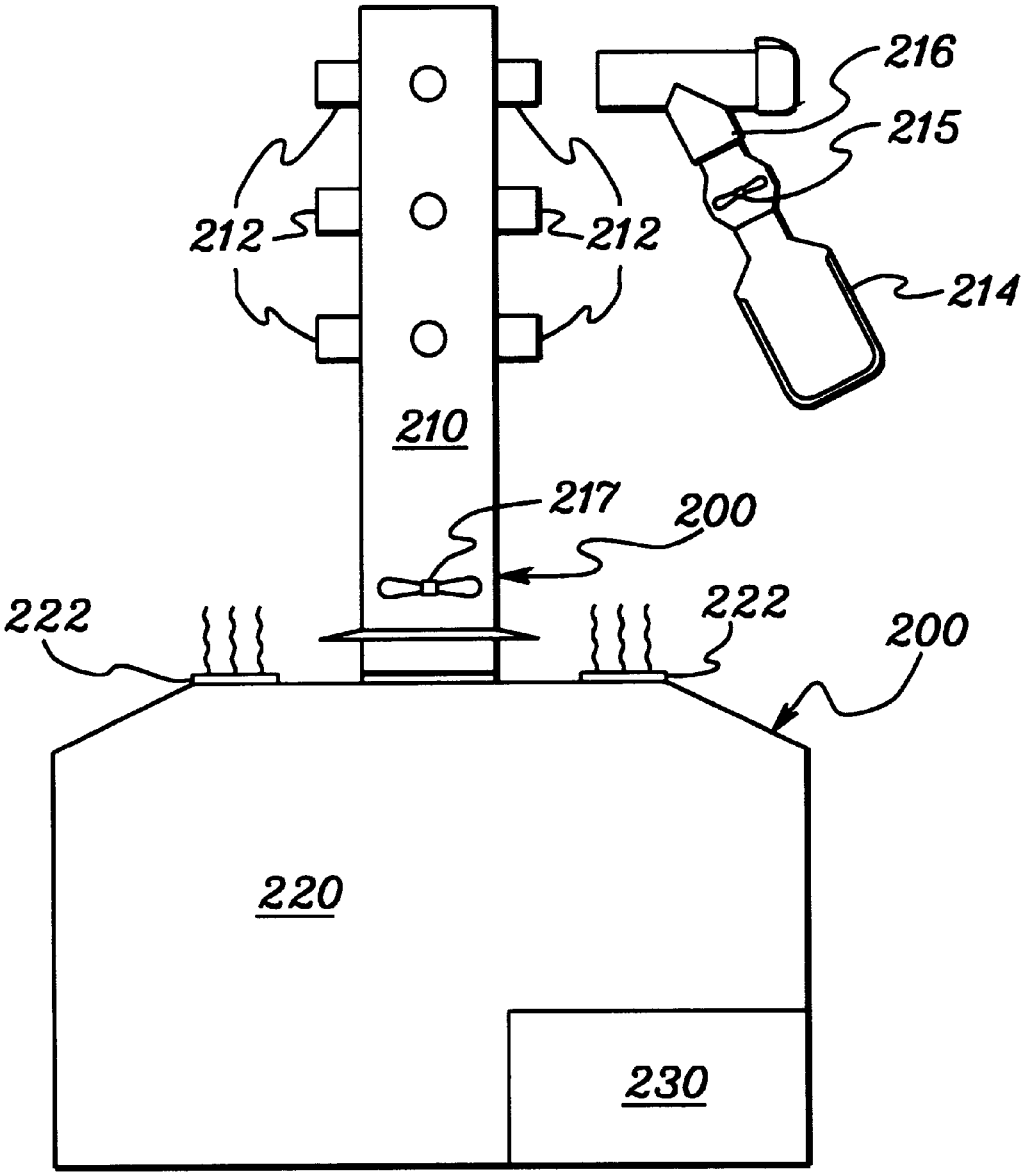
FIG. 4 is a schematic of an alternate embodiment of a freeze drying apparatus in accordance with the present invention.

FIG. 4 depicts an alternate embodiment of a freeze drying apparatus 200 in accordance with this invention. This apparatus utilizes a manifold 210 having a plurality of ports 212 each of which is capable of receiving an airtight quick disconnect valve 216 having connected thereto a container or product vial or flask 214. Apparatus 200 is shown with two different types of windmill sensors 215 & 217 (also referred to herein as vapor flow detectors) for detecting vapor flow. Sensor 215 provides feedback on product drying rate from only one associated container 214, while sensor 217 can provide collective information on product drying rate for all containers coupled to manifold 210. Obviously, sensors 215 & 217 could be used independently and still provide valuable information. Further, each quick disconnect valve 216 to be coupled to a port 212 of manifold 210 may include a vapor flow detector 215. Valve type sensor 215 could also be employed within each valve 42 of apparatus 10 of FIG. 1.

Manifold 210 couples to a condenser chamber 220 which has a vacuum established therein by a vacuum pump 230. In this embodiment, heat generated by a refrigeration compressor (not shown) for condenser chamber 220 is controllably expelled upwards through adjustable vents 222. This heat could again be used to enhance heat of sublimation during secondary drying of product within flasks coupled to manifold 210. Further, control of adjustable vents 222 could be manual, or electronic, e.g., pursuant to control signals sent from a process controller (not shown).

By way of further explanation, FIGS. 5*a* and 5*b* depict a freeze drying process in accordance with the present invention. Beginning with FIG. 5*a*, freeze drying starts 100 with loading of product 102 into the freeze drying apparatus. Cooling is initiated 104 to freeze product within the process chamber. The basic reason for pre-freezing a product is to lock its solid particles firmly into position so that moisture can be sublimed and physical and chemical reactions cannot take place. Once the product is frozen 106, a low condenser temperature is established 108, as well as a vacuum within the condenser chamber and the process chamber 110. Establishing the condenser and vacuum 112 allows initiation of removal of ice from the product in accordance with well known principles of sublimation. By way of typical example, freezing the product may entail four hours, while establishing the condenser and vacuum may require approximately half an hour of process time.

Sublimation is initiated by heating the product shelves 114 while carefully controlling pressure within the process chamber 116. A process loop is then entered wherein the shelf temperature is compared against a first set point 118. If shelf temperature is greater than this first set point, then the shelf temperature is cooled 119. Conversely, if the shelf temperature is less then the first set point 120, additional heating is added to the shelf 122. Next, processing determines whether the vacuum level is at a predefined value 124. If not, the vacuum level is regulated 126.

Assuming that the windmill sensor embodiment of the present invention is employed, the windmill speed is evaluated. If the windmill speed is less than a second predefined set point 128, the shelf temperature is increased (for example, by 5° C.) 130. By increasing the shelf temperature, the rate of evaporation is increased, thereby improving vapor flow from the product to the condenser chamber, and thus the RPM's of the windmill sensor. As an alternate process step, pressure within the process chamber could be increased in order to improve thermal conduction, and thereby enhance heat transfer to the product, and thus the rate of removal of water from the product in the form of water vapor.

After increasing shelf temperature 130, processing determines whether secondary drying has begun 132. The "post heat shelf set point" is predefined and occurs empirically at the transition point between primary drying and secondary drying. If the post heat shelf set point has been reached, then the secondary drying processing of FIG. 5*b* is employed 134. Otherwise, processing loops back to determine whether the shelf temperature is less then the first set point 120 described above.

If the windmill speed is less than the second set point, then processing determines whether its speed is greater than a third set point 136. (Note that the second and third set points of inquiries 128 and 136 can either be the same or different values as desired.) If the windmill speed is less then the third set point, then processing returns to evaluate the shelf temperature 120. However, if the RPM's of the windmill sensor are greater than the third set point, then the vaporization process is slowed by decreasing shelf temperature by, for example, 5° C. 138. Processing loops back to inquiry 118 to then compare the shelf temperature to the predefined set point.

FIG. 5*b* depicts one example of secondary drying processing in accordance with this invention. Secondary drying processing is commenced 150 with detection of the shelf temperature at the predefined post heat level in inquiry 132 of FIG. 5*a*. Once in secondary processing, the shelf temperature and processing chamber pressure are controlled to empirically determine set points 152. Processing evaluates whether the windmill sensor has stopped 154 and if not, loops back to continue secondary drying by controlling shelf heating and chamber pressure. Once the windmill has stopped, processing optionally determines whether a predefined secondary post heat time has also expired 156. If not, then additional drying may be employed until the predefined time has expired. Upon expiration of the post heat time, a freeze drying complete message 158 is provided, e.g., to an operator or system controller.

Those skilled in the art will recognize that various modifications to the routines described above and depicted in FIGS. 5*a* & 5*b* are possible without departing from the scope of the present invention. Several windmill feedback system routines are provided below by way of further example. In accordance with the present invention, freeze drying processing could include:

1. LOAD PRODUCT WITH PRODUCT PROBES IN THE CORRECT PRODUCT DEPTH.
2. PROGRAM AN AUTOMATED CYCLE THAT IS OPTIMIZED AND BASED ON THE CHARACTERISTICS OF THE PRODUCT.
3. START THE CYCLE (PROGRAM CONTROL).
4. THE PROGRAMMER TESTS THE PRODUCT PROBES TO SEE IF COMPLETE SOLIDIFICATION HAS BEEN ACHIEVED.
5. ADDITIONAL FREEZE CLOCK EXPIRES.
6. THE CONDENSER SYSTEM IS ESTABLISHED WHILE KEEPING THE SHELF TEMPERATURE AT IT'S CONTROL SETPOINT (ASSIST=ON).

ROUTINE #1:

1. THE OPERATOR HAS PREVIOUSLY PROGRAMMED A RECIPE THAT INCLUDES: AN INITIAL SHELF TEMPERATURE, PRESSURE SET POINT, POST HEAT (SECONDARY) TEMPERATURE SETPOINT AND WINDMILL SETPOINT.
2. SHELF HEAT IS ENABLED AND GOES TO THE DESIRED SETPOINT.
3. AFTER 60 MINUTES, THE SYSTEM COMPARES THE MEASURED WINDMILL SPEED AGAINST THE WINDMILL SETPOINT.
4. IF THE SPEED IS BELOW THE SETPOINT, THE SHELF TEMPERATURE IS INCREASED BY FIVE (5) DEGREES. IF THE SPEED IS ABOVE THE DESIRED WINDMILL SETPOINT, THE SHELF TEMPERATURE SETPOINT IS REDUCED BY FIVE (5) DEGREES.
5. AFTER ONE-HALF HOUR, THE WINDMILL ROUTINE AGAIN EXAMINES THE MEASURED WINDMILL SPEED AND CORRECTS BY MOVING THE SHELF TEMPERATURE SETPOINT.
6. ONCE THE RESULTING ROUTINE SHELF TEMPERATURE SETPOINT IS EQUAL TO THE SECONDARY POST HEAT TEMPERATURE, THE SHELF TEMPERATURE IS FIXED FOR THE DURATION OF PRIMARY DRYING.
7. THE WINDMILL SPEED IS CONSTANTLY MONITORED UNTIL THE MEASURED SPEED IS LESS THAN HALF OF THE DESIRED WINDMILL SETPOINT. AT THIS POINT THE CYCLE ADVANCES TO THE SECONDARY DRYING PHASE AND TEST ROUTINE.

ROUTINE #2

1. SAME AS ABOVE, BUT PROGRAMMED WITH MULTIPLE SHELF TEMPERATURE SETPOINTS, STEP TIMES, AND WINDMILL TEST SETPOINTS.
2. THE CONTROL SYSTEM CONTROLS THE SHELF TEMPERATURE AT THE FIRST SHELF TEMPERATURE SETPOINT FOR THE STEP DURATION SPECIFIED.
3. AT THE END OF THE FIRST STEP, THE MEASURED WINDMILL SPEED IS COMPARED

AGAINST THE STEP #1 WINDMILL TEST SETPOINT. IF THE MEASURED WINDMILL SPEED IS GREATER THAN THE WINDMILL SETPOINT, THE CONTROL SYSTEM HOLDS THE SYSTEM IN STEP #1 UNTIL THE MEASURED SPEED IS EQUAL TO OR LESS THAN THE STEP #1 WINDMILL TEST SETPOINT. IF WHEN FIRST TESTED, THE MEASURED SPEED WAS LESS THAN THE TEST WINDMILL SETPOINT, THE CONTROL SYSTEM ADVANCES TO THE SECOND STEP AND ITS ASSOCIATED SETPOINTS.

4. THE CONTROL SYSTEM ADVANCES THROUGH THE STEPS BASED ON THE TESTS OUTLINED ABOVE.
5. THE CONTROL SYSTEM EXITS THE ROUTINE WHEN THE LAST STEP IS COMPLETED OR THE AVERAGE PRODUCT TEMPERATURE IS EQUAL TO OR ABOVE THE SECONDARY SETPOINT.

ROUTINE #3

1. A COMBINATION OF METHODS ONE AND TWO. MULTIPLE STEPS ARE PROGRAMMED AND FOLLOWED, EXCEPT THAT IN EACH STEP THE SHELF TEMPERATURE IS MOVED HIGHER AND LOWER TO KEEP THE MEASURED SPEED AT THE DESIRED STEP WINDMILL SETPOINT.
2. NO EXIT TEST IS PERFORMED AS IN METHOD TWO.
3. ONCE THE POST HEAT VALUE IS ACHIEVED, THE SHELF TEMPERATURE IS FIXED UNTIL PRIMARY DRYING IS COMPLETE.
4. ONCE THE MEASURED SPEED DROPS TO ONE-HALF THE STEP SPEED SETPOINT AND THE SHELF TEMPERATURE IS FIXED AT THE POST HEAT SETPOINT, THE CYCLE ADVANCES TO SECONDARY DRYING.

SECONDARY DRYING AND EXIT TESTS

1. THE SHELF TEMPERATURE AND PRESSURE ARE CONTROLLED AT THE RECIPE PROGRAMMED SETPOINTS.
2. THE WINDMILL IS CONSTANTLY MONITORED UNTIL THE WINDMILL GOES TO ZERO. IF TIME REMAINS ON THE SECONDARY CLOCK THE CYCLE CONTINUES, BUT THE REMAINING TIME IS REDUCED TO FIFTY PERCENT OF ITS VALUE.
3. IF THE TIME WAS EXPIRED, THE CYCLE WAITS FOR ADDITIONAL TIME (TO COMPENSATE FOR BEARING FRICTION) THEN ADVANCES TO THE COMPLETE PHASE.

By way of further example, in a manifold application with a windmill sensor disposed in a central location, freeze drying processing could include:

1. PROPERLY CONNECT FREEZE DRYING FLASKS TO DRYING MANIFOLD.
2. CHECK LATER.
3. IF ICE OR CONDENSATION IS PRESENT ON THE EXTERIOR OF ALL FLASK SURFACES, CHECK LATER.
4. IF ICE OR CONDENSATION IS NOT PRESENT ON THE SURFACE OF ONE OR MORE FLASKS, AND THE WINDMILL IS TURNING, FEEL THE SURFACE TEMPERATURE OF THE FLASKS WITHOUT VISUAL CONDENSATION. IF FLASK FEELS APPROXIMATELY ROOM TEMPERATURE, PERFORM WINDMILL ISOLATION TEST.
5. WINDMILL ISOLATION TEST: MOVE THE QUICK SEAL ATTACHMENT VALVES ON ALL FLASKS, EXCEPT THE ONE FLASK TO BE TESTED, TO CLOSED POSITIONS. THE ONLY FLASK STILL OPENED TO THE VACUUM SYSTEM IS THE FLASK TO BE EVALUATED. OBSERVE THE SPEED OF MOVEMENT OF THE WINDMILL. IF PRODUCT CONTAINED IN THE FLASK UNDER EVALUATION IS DRY, THE WINDMILL WILL STOP IN LESS THAN FIVE MINUTES. IF THE FLASK IS NOT TOTALLY DRY, THE WINDMILL WILL CONTINUE TO TURN, EVEN AT A VERY SLOW RATE.
6. IF DRY, ROTATE THE QUICK SEAL ATTACHMENT VALVE TO THE CLOSE POSITION, AND REMOVE THE FLASK. OPEN THE QUICK SEAL VALVES FOR ALL OTHER CONNECTED FLASKS. IF WINDMILL IS STILL TURNING, REPEAT STEPS 4 & 5 PROCEDURE.
7. IF ALL CONNECTED FLASKS FEEL WARM TO THE TOUCH AND THE WINDMILL IS NOT TURNING, ALL FLASKS ARE CONSIDERED DRY AND CAN BE REMOVED.

Figure 6:
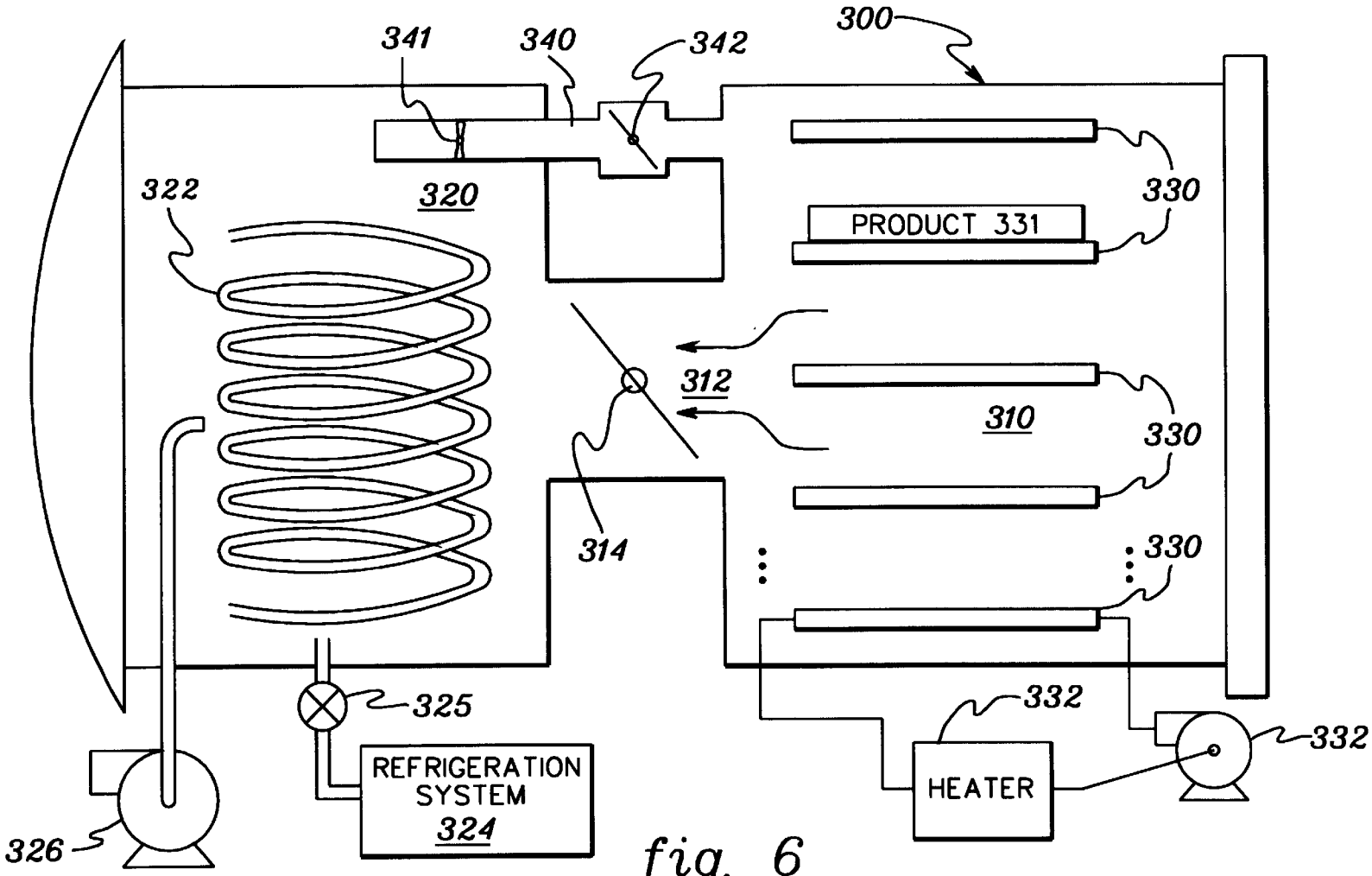
FIG. 6 is a schematic of still another embodiment of a freeze drying apparatus in accordance with the present invention.

FIG. 6 depicts an alternate embodiment of a freeze drying apparatus, generally denoted 300, in accordance with the present invention. This configuration comprises a large freeze drying system having a product or process chamber 310 with a plurality of shelves 330 each of which may hold a plurality of product containers 331. Process chamber 310 is in gaseous communication with a condenser chamber 320 through a large, primary channel 312, which includes an isolation valve 314. By way of example, channel 312 might be three feet in diameter. Condenser chamber 320 includes condenser coil 322 which is coupled through a control valve 325 to a refrigeration system 324. A vacuum is established within condenser chamber 320 and process chamber 310 via a vacuum pump 326. A cooling/heating system 332 is coupled to each product shelf 330 of the process chamber 310 for controlled cooling and heating of the product during freeze drying.

Apparatus 300 further includes a secondary channel 340 having a much smaller diameter than channel 312; for example, channel 340 might only be three inches in diameter. Channel 340 includes an isolation valve 342, and a vapor flow detector or windmill sensor 341 in accordance with the present invention. In one embodiment, this vapor flow detector comprises a windmill sensor such as described above. Advantageously, incorporating secondary channel 340 into the freeze drying apparatus allows windmill sensor size to be standardized (e.g., at three inches) for the different types of freeze drying apparatuses described herein. Standardizing on small windmill sensors is believed preferable to producing a variety of such sensors for various size channels. Along with the greater expense of implementing a windmill sensor on, e.g., a three foot scale, the scale itself could reduce monitoring sensitivity and/or sensor life, e.g., if bearings are constantly exposed to a high vapor transport rate. As described further below, apparatus 300 will employ the vapor flow detector only during secondary drying and principally to detect end of drying.

As a specific example, after passage of a predetermined amount of time, isolation valve 314 is closed to prevent vapor flow through channel 312. Simultaneously, isolation valve 342 is opened to permit flow through channel 340. The rotation or lack of rotation of windmill sensor 341 is then sensed visually or electronically to determine whether the drying process is complete. If the windmill still turns, water vapor is emanating from the product chamber, and the freeze drying process must continue. The large isolation valve 314 is reopened and the secondary isolation valve 342 is closed. This test may be performed periodically during the secondary drying cycle, either manually or automatically.

Figure 7:
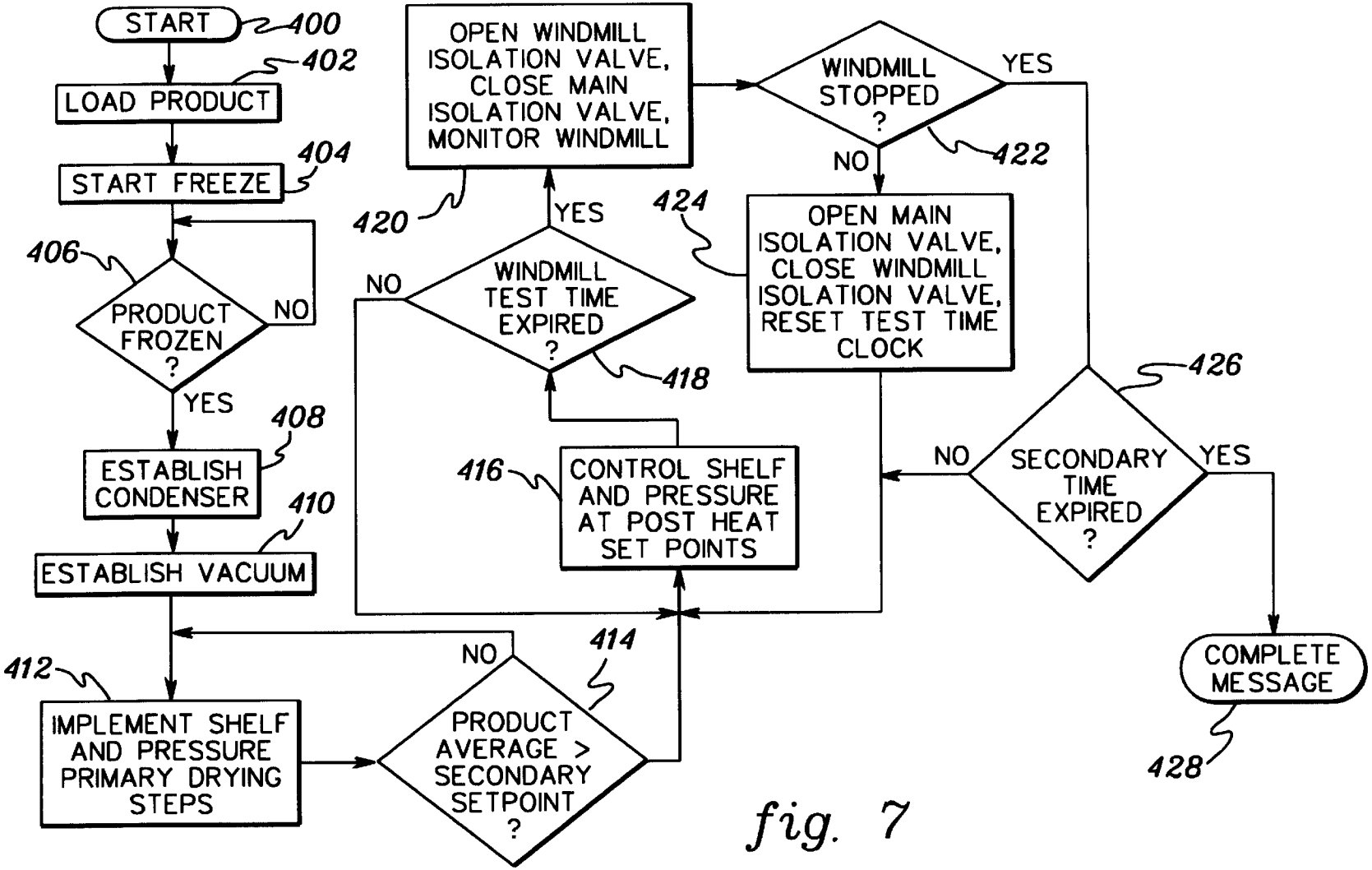
FIG. 7 is a flowchart of one embodiment of freeze drying processing using the freeze drying apparatus of FIG. 6.

FIG. 7 presents one freeze drying process embodiment employing the twin isolation valve apparatus 300 of FIG. 6. Freeze drying begins 400 with loading of product 402 into the process chamber and the commencement of freezing of the product 404 as described above in connection with FIG. 5*a*. Processing waits until the product is frozen 406 (which as noted above, may require four hours). Once the product is frozen, the condenser 408 and vacuum 410 are established, and the shelf and pressure primary drying steps are implemented 412. Freeze drying continues while processing determines whether an average product temperature exceeds a predefined secondary drying set point 414.

Once the secondary set point is exceeded, the shelf temperature and pressure within the process chamber are controlled at predefined post-heat set points 416 as will be understood by one skilled in the art. After commencing secondary drying, processing inquires whether a windmill test time has expired 418. Once the test time has expired, the secondary (windmill) isolation valve is opened, the main isolation valve is closed and processing monitors windmill speed 420 to determine whether the windmill sensor has stopped rotating 422. If still rotating, then the main isolation valve is reopened, the windmill isolation valve is closed and the test time clock is reset 424. However, if the windmill has stopped, then processing (optionally) determines whether a predefined secondary drying time has expired 426. This inquiry is used as a backup to ensure completion of the freeze drying process. Once the predefined secondary drying time has expired, a freeze dry complete message 428 is sent to the operator or a system controller.

Figure 8:
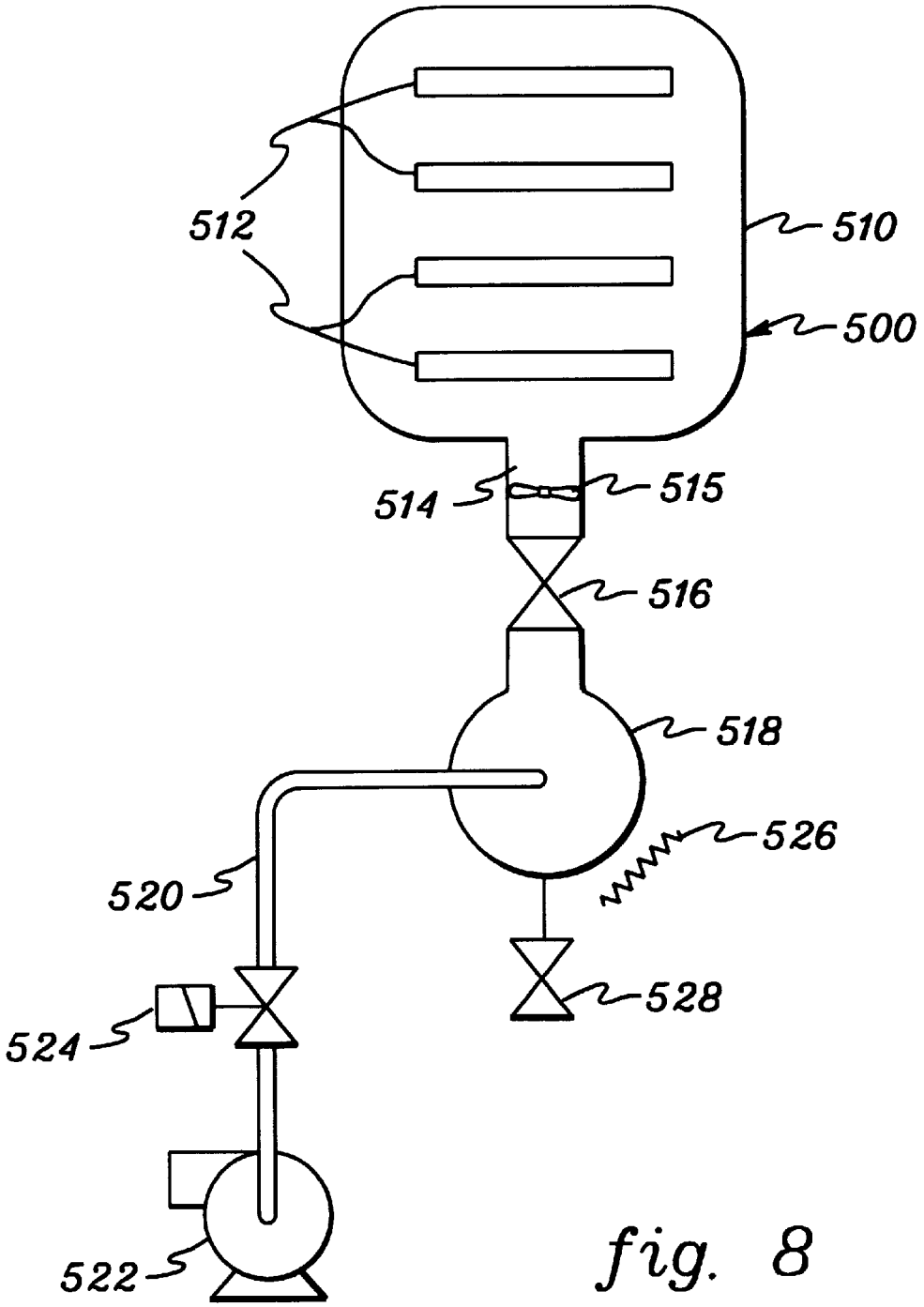
FIG. 8 is a schematic of a further embodiment of a freeze drying apparatus to employ monitoring and control techniques in accordance with the present invention.
Figure 9:
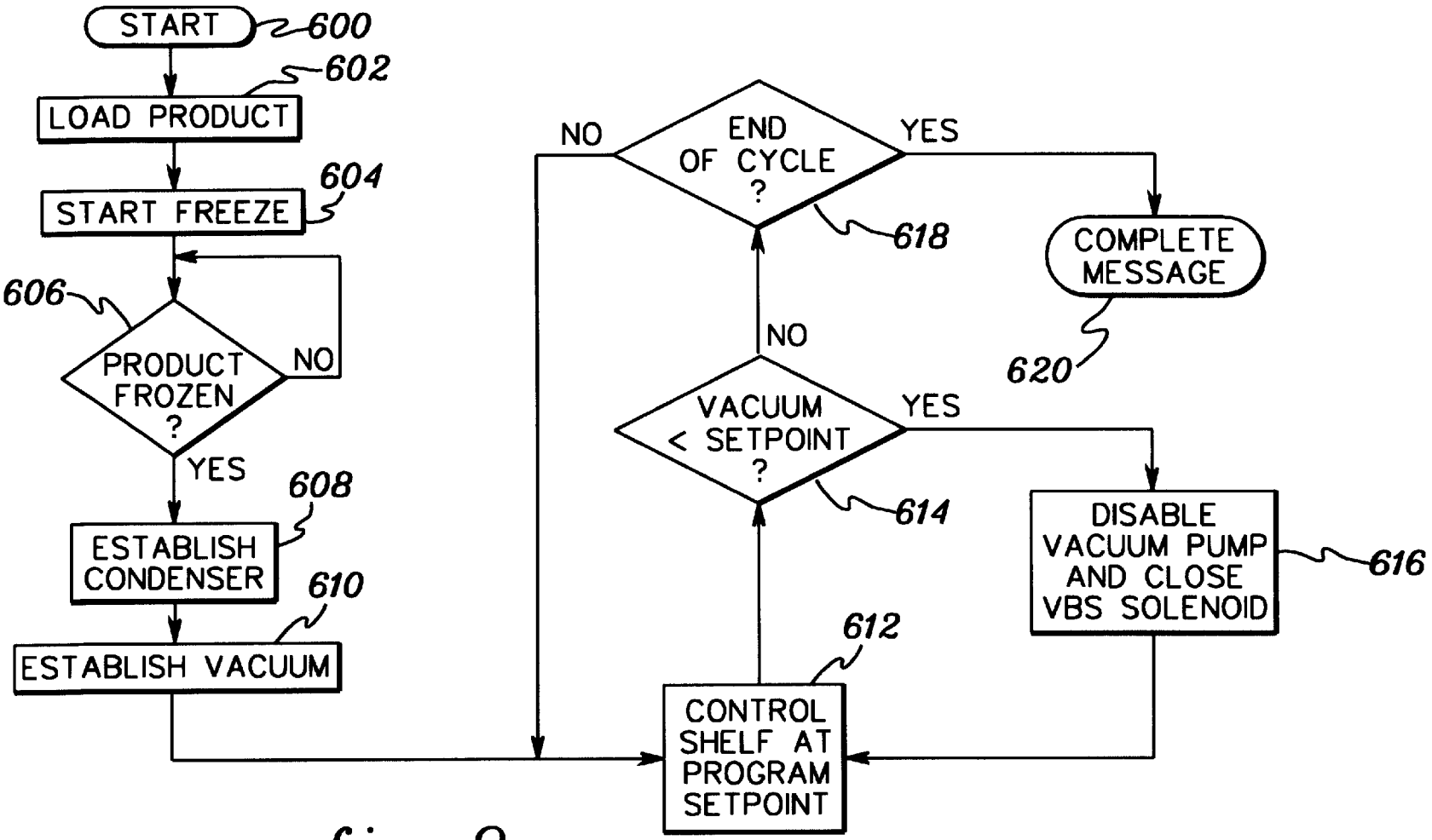
FIG. 9 is a flowchart of one embodiment of a controlled freeze drying process in accordance with this invention.

FIGS. 8 & 9 depict a further aspect of the present invention. Shown in FIG. 8 is an external freeze drying apparatus 500 wherein a process chamber 510, having a plurality of product shelves 512, couples through a communication port 514 and a valve 516 to a condenser chamber 518. Condenser chamber 518 receives a vacuum through passageway 520, which is coupled to a vacuum pump 522. An in-line vacuum brake solenoid (VBS) or control valve 524 is also shown. Defrost heater 526 and condenser drain plug/valve 528 are provided for defrosting a condenser within condenser chamber 518. Apparatus 500 also preferably includes a vapor flow detector, such as a windmill sensor 515 in accordance with the present invention. In conventional implementation, apparatus 500 would include a vacuum control solenoid valve (not shown) at the process chamber for control of pressure.

In this aspect, the present invention comprises an energy savings technique wherein the system's vacuum pump is automatically disabled whenever pressure is numerically below a predefined vacuum level set point. The approach is to allow the water vapor itself to then moderate pressure within the process chamber. Control of pressure is thus accomplished by selectively enabling and disabling the vacuum pump during freeze drying in response to the actual vacuum level within the process chamber. Advantageously, by selectively disconnecting the vacuum pump, oil migration or "backstreaming" from the pump is inherently reduced by the percentage of off-time, as well as reducing the vacuum pump operational temperature. Control of pressure by selective disabling of the vacuum pump can also be used to achieve a higher level of product purity since the conventional requirement for an inert gas bleed system and solenoid valve connected to the process chamber is eliminated. The same level of process control is achieved, however, by switching the vacuum pump on and off as desired to maintain the vacuum level. Additionally, this aspect of the invention may speed freeze drying by using higher specific heat water vapor rather than air or inert gas to provide convective heat transfer.

As an alternate or enhanced embodiment, solenoid 524 can also be used to precisely control the pressure (vacuum level) in the process chamber. The present invention essentially comprises achieving precise pressure control by backing up the pressure in the process chamber with the product water vapor itself. The invention works extremely well when drying actual product and avoids the inherent problem of setting a mechanical bleed solenoid's flow orifice for different pressure levels. The vacuum line on/off control works well as a stand alone control, or with an automated microprocessor-based freeze dryer control system.

Selective shutting down of the vacuum pump 522 again results in power savings and a reduction in vacuum pump oil back migration. When the pressure is reduced to a level close to the so-called "molecular flow range", organic oil molecules are free to move around in the vacuum piping and the rest of the system. This could result in pollution to the system's condenser and to the process chamber. Numerous research papers have identified this phenomenon and the most accepted practice employed today is to maintain the pressure above the so-called "molecular flow range" (i.e., 100 Millitorr).

There is a direct correlation between the backstreaming phenomenon and the operating temperature of an oil-filled vacuum pump. The backstreaming molecules are mainly comprised of molecules of light hydrocarbon fractions from the oil (high vapor pressure fractions) together with the cracking derivatives of these hydrocarbons. The molecules result from the relatively high temperature of the oil film covering various moving parts of the vacuum pump's veins and rotor. The typical Leybold vacuum pump operates at 1500 or 1750 RPMs, which produces thermal energy through the pump's moving parts (friction) and by gas compression in the pump body. Selection of vacuum pump oil and reducing the average pump body temperature are critical in reducing oil molecule backstreaming. Vacuum systems operating in the molecular flow range have a much higher probability of backstreaming. Thus, controlling the pressure in the freeze drying system numerically above 100 Millitorr or in the viscous flow range, will significantly reduce probability of oil particles backstreaming. By selectively shutting off the vacuum pump as proposed herein, pump temperature is reduced thereby further reducing probability of oil particle backstreaming.

Significant advantages to this aspect of the present invention thus include the low probability of oil migration and the decrease in average vacuum pump body temperature. Tests conducted show that control valve 524 will be "off" greater than ninety-five percent of the time during the end of primary drying and during secondary drying. This off-time can be utilized to automatically turn the vacuum pump off and allow the average temperature of the vacuum pump to return to ambient temperature, as well as to physically close off the vacuum line. As an alternative, automated control of only the vacuum pump, without use of the VBS solenoid 524, could also be employed in accordance with this invention.

To summarize, a control technique is disclosed herein for utilizing a pressure control point to disable flow to the vacuum pump, and shortly thereafter to turn the vacuum pump off. When the system's vacuum is indicated by the main vacuum transducer to have increased above a desired pressure set point, the vacuum pump is re-enabled and the foreline solenoid is opened. During the quiescent period, the source of possible contamination is sealed and the vacuum pump is off and cooling. Processing in accordance with this feature of the invention is depicted in FIG. 9.

The freeze drying process again begins 600 with the loading 602 and freezing of product 604. Note that the product can be frozen via shelf refrigeration or flasks can be prepared in separate low temperature baths. Once the product is frozen 606, the condenser 608 and vacuum 610 are established. Processing then controls shelf temperature at a programmed set point(s) 612 and inquires whether the vacuum level is less than a predefined set point 614. If so, the vacuum pump 616 is disabled, and the VBS solenoid is closed 616 closing the passageway.

Once the vacuum pump is disabled, product vapor generates a numerical increase in pressure within the process chamber. Once the pressure rises above a predefined set point, the vacuum pump and VBS solenoid are re-enabled. When the remaining ice in the product fails to generate a sufficient pressure increase to raise the pressure above this programmed set point, the vacuum pump will remain in a quiescent state. At this point, the on-time is primarily determined by the unit's vacuum leak rate. The pressure measured in the system is held numerically low by the low temperature of the condenser system and the low temperature ice surface. When the vacuum level is less than the predefined set point, processing inquires whether a predefined freeze drying cycle time interval has expired 618. Once the end of cycle is reached, a freeze dry complete message 620 is provided.

Those skilled in the art will note from the above discussion that the present invention comprises a freeze drying apparatus and associated lyophilization procedure employing vapor flow detection and/or vacuum disconnect/connect control for improved monitoring and control of the freeze drying process. A vapor flow detector in accordance with the principles of the this invention can provide visual and/or electronic feedback on drying rate, as well as function as an end of drying indicator. The rate of drying can be utilized in an electronic feedback signal to automatically regulate, for example, shelf heat temperature and/or vacuum level during freeze drying processing. In large industrial freeze dryers, an end of freeze drying indicator can be obtained using an alternate test path from the product chamber to the condenser. The vapor flow detector installed in this alternate path is selectively used only in the final stages of freeze drying to identify completion of the process. In a manifold apparatus, a central vapor flow detector or individual detectors located at flask attachment ports can be used separately or in combination.

Selective control of the vacuum pump during lyophilization processing can provide energy savings by automatically disabling the vacuum pump when pressure in the process chamber is below a predefined set point. Controlling pressure within the process chamber is accomplished by enabling and disabling the vacuum pump in response to measured pressure within the chamber. Further, selectively disabling the vacuum pump reduces vacuum pump oil migration or "backstreaming" by the percentage of off-time, along with reducing vacuum pump operation temperature. By controlling pressure within the process chamber by connecting/disconnecting the vacuum pump, a higher level of sterility is achieved by eliminating the conventional requirement of an inert gas bleed system, while still providing comparable level of pressure control utilizing pressure generated by the product undergoing freeze drying. The speed of freeze drying will also increase since higher specific heat water vapor is employed, rather than air or inert gas to provide convective heat transfer within the process chamber.

A further advantage of the present invention arises from employing the refrigeration system's discharge heat to selectively increase the rate of freeze drying by increasing the surrounding heat (heat of sublimation) over freeze drying flasks connected to a freeze dryer's manifold system. Adjustable vents can be used to manually or automatically adjust heat flow over the freeze drying flask as desired.

While the invention has been described in detail herein in accordance with certain preferred embodiments thereof, many modifications and changes therein may be affected by those skilled in the art. Accordingly, it is intended by the appended claims to cover all such modifications and changes as fall within the true spirit and scope of the invention.

What is claimed is:

1. A freeze drying apparatus comprising:

a process chamber for accommodating a plurality of product containers;

a condenser chamber in communication with said process chamber via a channel;

a vacuum source for producing a vacuum on said condenser chamber and process chamber; and a vapor flow detector disposed to monitor vapor flow to said condenser chamber from product exposed in said process chamber.

2. The freeze drying apparatus of claim 1, wherein said vapor flow detector comprises a windmill sensor disposed within said channel coupling said process chamber and said condenser chamber, wherein vapor flow through said channel causes rotation of said windmill sensor.

3. The freeze drying apparatus of claim 2, wherein said windmill sensor is disposed within said channel to be visually perceptible by an operator during freeze drying processing using said freeze drying apparatus.

4. The freeze drying apparatus of claim 3, wherein said process chamber comprises a batch process chamber containing at least one shelf for holding said plurality of product containers.

5. The freeze drying apparatus of claim 1, wherein said process chamber comprises a manifold having a plurality of flask attachment ports for receiving a plurality of product containing drying flasks.

6. The freeze drying apparatus of claim 5, wherein said freeze drying apparatus further comprises at least one separate vapor flow detector associated with at least one flask attachment port for monitoring vapor flow from product within at least one drying flask connected to said at least one flask attachment port.

7. The freeze drying apparatus of claim 1, wherein said vapor flow detector comprises means for detecting a rate of drying and end of drying of product exposed in said process chamber.

8. The freeze drying apparatus of claim 7, wherein said vapor flow detector comprises means for providing visual feedback of said rate of drying and said end of drying to an operator.

9. The freeze drying apparatus of claim 7, wherein said freeze drying apparatus further comprises a process controller, and means for communicating said rate of drying and said end of drying monitored by said vapor flow detector to said process controller.

10. The freeze drying apparatus of claim 9, wherein said process controller comprises means for employing said rate of drying to automatically regulate at least one adjustable parameter of said process chamber.

11. The freeze drying apparatus of claim 1, wherein said channel comprises a secondary channel, and said freeze drying apparatus further comprises a main vapor flow channel interconnecting said process chamber and said condenser chamber, said main vapor flow channel having a larger internal diameter than said secondary channel, and wherein said freeze drying apparatus further comprises means for using said vapor flow detector to detect termination of freeze drying processing by selectively diverting vapor flow through only said secondary channel.

12. The freeze drying apparatus of claim 11, wherein said means for using comprises a first isolation valve in said main vapor flow channel and a second isolation valve in said secondary channel, and wherein said freeze drying apparatus further comprises automated means for closing said first isolation valve and opening said second isolation valve for selective sensing of vapor flow through said secondary channel using said vapor flow detector.

13. The freeze drying apparatus of claim 1, wherein said process chamber comprises a manifold having a plurality of flask attachment ports, and wherein said freeze drying apparatus further comprises means for selectively applying heat to one or more flasks coupled to said plurality of flask attachment ports.

14. The freeze drying apparatus of claim 13, wherein said condenser chamber includes a condenser cooled by a heat producing compressor, and wherein said means for selectively applying heat comprises adjustable vents for directing heat produced by said heat producing compressor onto said one or more flasks coupled to said plurality of flask attachment ports of said manifold.

15. The freeze drying apparatus of claim 1, further comprising automated control means for disconnecting said vacuum source from said condenser chamber and process chamber during freeze drying processing of product exposed in said process chamber, said automated control means initiating said disconnecting whenever vacuum pressure within said process chamber drops below a predefined set point during freeze drying processing.

16. The freeze drying apparatus of claim 15, wherein said vacuum source comprises a vacuum pump, and wherein said automated control means for disconnecting said vacuum pump comprises means for automatically shutting off said vacuum pump whenever pressure within said process chamber drops below said predefined set point during freeze drying processing of product exposed in said process chamber.

17. The freeze drying apparatus of claim 16, wherein said automated control means further comprises means for turning on said vacuum pump whenever pressure within said condenser chamber rises above a predefined upper set point during freeze drying processing of product exposed to said process chamber.

18. The freeze drying apparatus of claim 15, wherein said automated control means for disconnecting said vacuum source comprises a solenoid valve coupled between said vacuum source and said condenser and process chambers, said solenoid valve comprising means for controllably connecting/disconnecting said vacuum source from said condenser and process chambers whenever pressure within said process chamber during freeze drying processing is outside a predefined range.

19. A freeze drying apparatus for freeze drying product adapted to be contained in a frozen state in at least one flask, said freeze drying apparatus comprising:

a manifold presenting a sealed interior chamber and at least one port adapted to receive said at least one flask to place the interior of said flask and product therein in gaseous communication with said interior chamber;

a condenser associated with said interior chamber of said manifold for condensing condensible vapors present in said interior chamber;

a vacuum pump for producing a vacuum within said interior chamber of said manifold for reducing ambient pressure in said interior chamber; and a vapor flow detector for monitoring vapor flow from product in at least one flask coupled to said manifold during freeze drying processing using said freeze drying apparatus.

20. The freeze drying apparatus of claim 19, wherein said condenser is disposed within a condenser chamber, and said manifold couples to said condenser chamber via a channel, and wherein said vapor flow detector comprises a main vapor flow detector disposed in said channel interconnecting said manifold and said condenser chamber.

21. The freeze drying apparatus of claim 20, wherein said condenser is driven by a refrigeration source, and wherein said freeze drying apparatus further includes adjustable vents between said refrigeration source and said at least one flask for selectively directing exhaust heat from said refrigeration source onto said at least one flask during freeze drying processing.

22. The freeze drying apparatus of claim 20, further comprising at least one vapor flow port detector, each vapor flow port detector being associated with one port of said manifold to detect vapor flow from product in one flask coupled to said one port.

23. The freeze drying apparatus of claim 19, wherein said vapor flow detector is associated with one port of said manifold for monitoring vapor flow from product contained within one flask coupled to said one port.

24. A freeze drying apparatus for freeze drying product, said freeze drying apparatus comprising:

a process chamber for accommodating a plurality of product containers;

a vacuum pump for producing a vacuum on said process chamber; and a process controller connected to said vacuum pump, said process controller monitoring freeze drying within said freeze drying apparatus and during freeze drying processing selectively disconnecting said vacuum pump from said process chamber without impairing freeze drying processing within said freeze drying apparatus.

25. The freeze drying apparatus of claim 24, wherein said process controller comprises means for shutting off said vacuum pump whenever pressure within said process chamber is less than a first predefined vacuum level and for turning on said vacuum pump whenever pressure within said process chamber exceeds a second predefined vacuum level.

26. The freeze drying apparatus of claim 25, wherein said first predefined vacuum level and said second predefined vacuum level are an identical set point.

27. The freeze drying apparatus of claim 24, wherein said process controller comprises means for regulating pressure within said process chamber utilizing water vapor from said product undergoing freeze drying processing.

28. The freeze drying apparatus of claim 24, further comprising a solenoid valve coupled between said vacuum pump and said process chamber, said solenoid valve being employed by said process controller to selectively disconnect/connect said vacuum pump without impairing freeze drying processing.

29. The freeze drying apparatus of claim 28, wherein said process controller comprises means for disconnecting said vacuum pump during secondary drying of product undergoing freeze drying processing whenever pressure within said process chamber drops below a predefined vacuum level.

30. The freeze drying apparatus of claim 24, wherein said process chamber includes at least one shelf for holding said plurality of product containers, and wherein said freeze drying apparatus further comprises a condenser chamber in communication with said process chamber and a vapor flow detector disposed between said process chamber and said condenser chamber, said vapor flow detector monitoring vapor flow to said condenser chamber from product exposed in said process chamber.

31. The freeze drying apparatus of claim 24, wherein said process chamber comprises a manifold presenting a sealed interior chamber and at least one port adapted to receive at least one flask to place the interior of said flask, and product contained therein, in gaseous communication with said interior chamber, and wherein said freeze drying apparatus further comprises at least one vapor flow port detector disposed at said at least one port for monitoring vapor flow from product within at least one flask coupled thereto.

32. The freeze drying apparatus of claim 31, further comprising a condenser chamber in communication with said manifold and a main vapor flow detector disposed between said interior chamber of said manifold and said condenser chamber, said main vapor flow detector monitoring vapor flow from product in gaseous communication with said interior chamber.

* * * * *